United States Patent [19]

Murayoshi

[11] 4,268,025

[45] May 19, 1981

[54] SHEET FEEDING APPARATUS

[75] Inventor: Seizi Murayoshi, Machida, Japan

[73] Assignee: Ricoh Company, Ltd., Tokyo, Japan

[21] Appl. No.: 94,757

[22] Filed: Nov. 15, 1979

[30] Foreign Application Priority Data

Nov. 21, 1978 [JP] Japan ..... 53-143867

[51] Int. Cl.[3] ..... B65H 3/64

[52] U.S. Cl. ..... 271/112; 271/121

[58] Field of Search ..... 271/112, 121, 122, 125, 271/94–96

[56] References Cited

U.S. PATENT DOCUMENTS 4,018,434 4/1977 Mitchell ..... 271/96

4,113,244 9/1978 Ruenzi ..... 271/121 X

OTHER PUBLICATIONS

IBM Technical Disclosure Bulletin, vol. 13, No. 9, p. 2567, Feb. 1971, "Vacuum Document Picker," C. H. Souba.

*Primary Examiner*—Richard A. Schacher

*Attorney, Agent, or Firm*—Wyatt, Gerber, Shoup, Scobey & Badie

[57] ABSTRACT

In a sheet feeding apparatus comprising a sheet receptacle for placing sheets thereon, a vacuum plate which is disposed above the sheet receptacle and which has a sheet suction hole in bottom portion thereof directed to the sheet receptacle, a casing for covering the vacuum plate, a fan for bringing a space between the vacuum plate and the sheet receptacle to a negative pressure by sucking air from the casing, a sheet feed roller, which is disposed rotatably in the casing and a sheet transport portion which is exposed to the side of the sheet receptacle through the vacuum plate, a sheet separating roller which is rotatably disposed, downstream of the sheet feed roller, in the sheet transport path, and a drive apparatus for driving each of the rollers in the sheet feeding direction, an improvement is made in that the sheet separating roller is disposed in the casing and part of the peripheral surface of the sheet separating roller is exposed to the side of the sheet receptacle through the vacuum plate and in contact with a frictional member disposed below the sheet separating roller.

5 Claims, 5 Drawing Figures

SHEET FEEDING APPARATUS

BACKGROUND OF THE INVENTION

This invention relates to a sheet feeding apparatus for feeding originals, copy sheets or other documents to a copying machine or to a facsimile apparatus, and more particularly to an air suction type sheet feeding apparatus in which sheets are individually sucked upwards by a negative pressure from a top sheet of a sheet stack placed on a sheet receptacle and under the condition, a sheet feed roller is rotated so that the sucked sheets are individually fed into the copying machine or facsimile apparatus.

The air suction type sheet feeding apparatus has an excellent feature capable of feeding sheets individually with different sizes and rigidities since sheets are individually sucked from a top sheet of the sheets stacked on a sheet receptacle. Therefore, practically it is mainly used as the sheet feeding apparatus of facsimile apparatus.

As a sheet feeding apparatus of the air suction type, an apparatus as shown in FIG. 1 is known. This apparatus comprises a sheet receptacle 2 for placing a stack of sheets 1 thereon, a vacuum plate 3 which is disposed above the sheet receptacle 2 and which has a sheet suction hole 3*a* in the bottom thereof directed to the sheet receptacle 2, a casing 4 which covers the vacuum plate 3, a fan 6 for sucking air from the casing 4 in order to bring a space 5 between the vacuum plate 3 and the sheet receptacle 2 to a negative pressure state, a sheet feed roller 7, which is disposed rotatably in the casing 4 and a sheet transport portion thereof is exposed to the side of the sheet receptacle 2 through the vacuum plate 3, a sheet separating roller 8 which is disposed rotatably downstream of the sheet transport path with respect to the sheet feed roller 7, namely on the right in FIG. 1, a frictional sheet separating plate 9 which is disposed in light contact with the peripheral surface of the sheet separating roller 8, and a drive apparatus 10 for rotating each of the above-mentioned rollers in the sheet transporting direction.

In this sheet feeding apparatus of FIG. 1, the fan 6 is rotated so that the atmospheric pressure in the casing 4 which covers the sheet feed roller 7 is made negative, whereby the space 5 between the vacuum plate 3, which constitutes a bottom plate of the casing 4, and the upper surface of sheets 1 is also made negative, and the top sheet of a stack of sheets 1 placed on the sheet receptacle 2 is sucked to the lower surface of the vacuum plate 3, and under this condition, the sheet feed roller 7 is rotated, so that the top sheet 1 is transported in the downstream direction of the sheet transport path. The sheet 1 transported from the sheet receptacle 2 by the sheet feed roller 7 is prevented from being double fed, by the sheet separation roller 8 and the frictional sheet separation plate 9 which is in elastic contact with the peripheral surface of the sheet separation roller 8, so that only one sheet is fed into the copy machine or the facsimile apparatus.

Referring to FIG. 2, in this sheet feeding apparatus, when a leding edge portion 1*a* of the sheet 1 fed goes beyond an end portion 3*b* of the vacuum plate 3 and is positioned in between the end portion 3*b* and the contact point of the sheet separation roller 8 between the frictional sheet separating plate 9, the leading edge portion 1*a* is not guided forcibly or is in the so-called guide free state. Therefore, when sheets are thin, flexible or curled, the leading edge portion 1*a* is not stiff enough and so long as the sheet is in the above-mentioned state, the leading edge portion 1*a* is prevented from being advanced by its friction with the frictional sheet separating plate 9, although the leading edge portion 1*a* may reach the frictional sheet separating plate 9. Therefore, the sheet waves, and adequate sheet transportation becomes difficult. The phenomenon for the leading edge portion 1*a* to be prevented from being advanced by its friction with the frictional sheet separating plate 9 will occur in the following cases: too small to overcome the frictional force caused by the contact of the leading edge 1*a* with the frictional separating plate 9, and a second case is that the leading edge 1*a* comes to contact with the frictional sheet separating plate 9 with an obtuse angle due to the curl of the sheet as shown by reference symbol 1A in FIG. 2. This phenomenon can be avoided to some extent if sheets with appropriate quality and thickness are selected. However, when the form, size and thickness of sheets (originals) to be fed vary as in the case of facsimile apparatus, the above-mentioned phenomenon is unavoidable in the conventional sheet feeding apparatus.

SUMMARY OF THE INVENTION

It is therefore an object of the invention to provide a sheet feeding apparatus of air suction type capable of performing sheet separation and feeding adequately irrespective of the type, quality and thickness or the like of sheets to be fed.

According to the invention, in a sheet feeding apparatus comprising a sheet receptacle for placing sheets thereon, a vacuum plate which is disposed above the sheet receptacle and which has a sheet suction hole in a bottom portion thereof directed to the sheet receptacle, a casing for covering the vacuum plate, a fan for bringing a space between the vacuum plate and the sheet receptacle to a negative pressure by sucking air from the casing, a sheet feed roller, which is disposed rotatably in the casing and a sheet transport portion which is exposed to the side of the sheet receptacle through the vacuum plate, a sheet separating roller which is rotatably disposed, downstream of the sheet feed roller, in the sheet transport path, and a drive apparatus for driving each of the rollers in the sheet feeding direction, an improvement is made in that the sheet separating roller is disposed in the casing and part of the peripheral surface of the sheet separating roller is exposed to the side of the sheet receptacle through the vacuum plate and in contact with a frictional member disposed below the sheet separating roller.

DESCRIPTION OF THE PREFERRED EMBODIMENT

Figure 3:
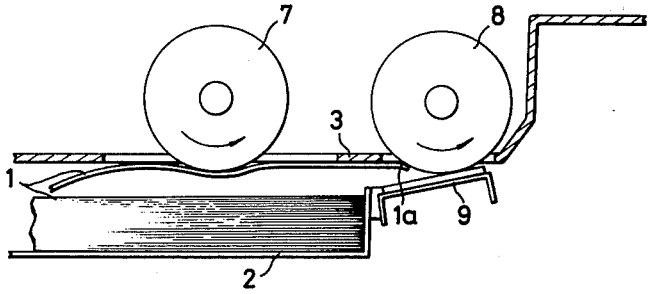
FIG. 3 is a diagrammatical sectional view of a main portion of an embodiment of a sheet feeding apparatus according to the invention.

Referring to FIG. 3, there is shown diagrammatically a main portion of a sheet feeding apparatus of the invention. In FIG. 3, reference numeral 1 represents sheets, reference numeral 2 a sheet receptacle, reference numeral 3 a vacuum plate, reference numeral 7 a sheet feed roller, reference numeral 8 a sheet separating roller, and reference numeral 9 a frictional sheet separating plate, respectively.

Figure 1:
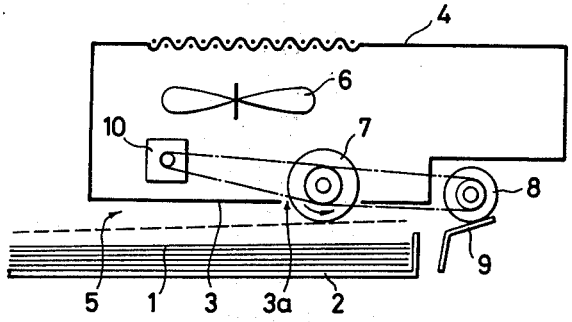
FIG. 1 (PRIOR ART)
FIG. 1 is a diagrammatical view of a conventional sheet feeding apparatus of air suction type.
Figure 2:
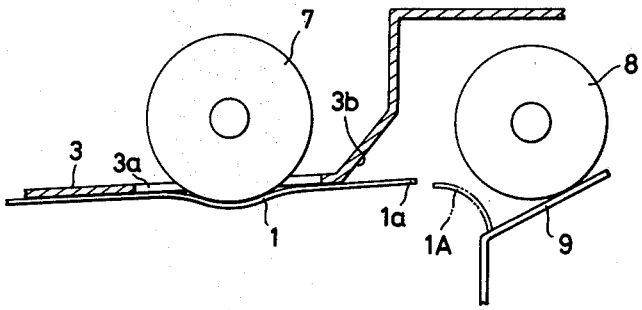
FIG. 2 (PRIOR ART)
FIG. 2 is a diagrammatical sectional view of a main portion of the sheet feeding apparatus of FIG. 1.

A feature of the invention is that, unlike the sheet feeding apparatus as shown in FIG. 1, the sheet separating roller 8 is disposed in the casing 4 (refer to FIG. 1) as shown in FIG. 3, and that part of the peripheral surface of the sheet separating roller 8 is exposed to the side of the sheet receptacle 2 through the vacuum plate 3. Namely, according to the invention, the sheet separating roller 8 is disposed in the casing 4 and part of the outer peripheral surface of the roller 8 is exposed to the side of the sheet receptacle 2 through the vacuum plate 3, whereby the leading edge 1*a* of sheet to be fed is guided so as to advance, while sucked to the vacuum plate 3, along the peripheral surface of the sheet separating roller 8, so that it is prevented that the leading edge 1*a* of each sheet becomes free from any guide in an intermediate position between the sheet feed roller 7 and the sheet separating roller 8.

Therefore, since the leading edge 1*a* of each sheet is guided half forcibly along the vacuum plate 3, while sucked thereto, irrespective of its rigidity, thickness and curl of the sheet, it does not occur that the leading edge 1*a* of each sheet comes to contact with the frictional sheet separating plate 9 with an obtube angle, and the sheet waving phenomenon is prevented. Thus, the sheet feeding apparatus of the air suction type according to the invention attains stable sheet feeding and reduces the ratio of sheet feed error drastically and, at the same time, makes it possible to perform smooth sheet separation and feeding, irrespective of the qualities of sheets to be fed, the surface smoothness, the presence of curls and the thickness of sheets or combination of various types of sheets.

Figure 4:
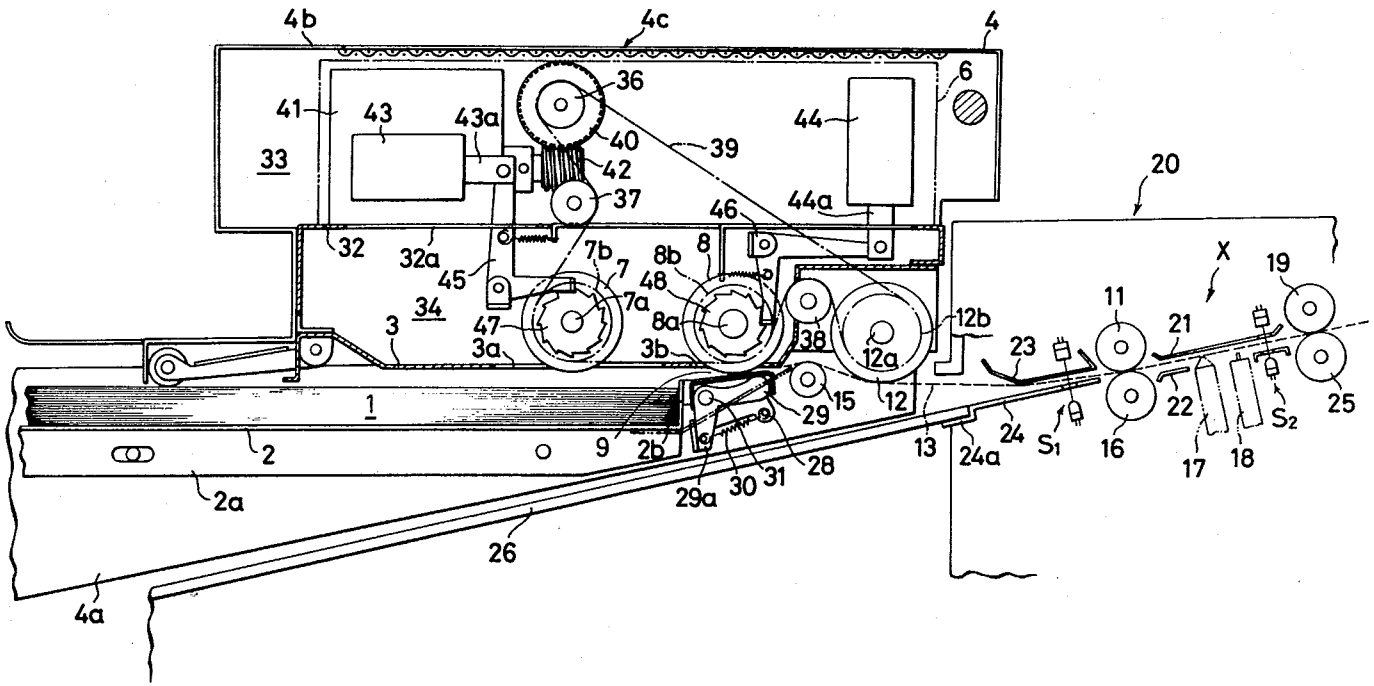
FIG. 4 is a diagrammatical sectional side view of another sheet feeding apparatus according to the invention.
Figure 5:
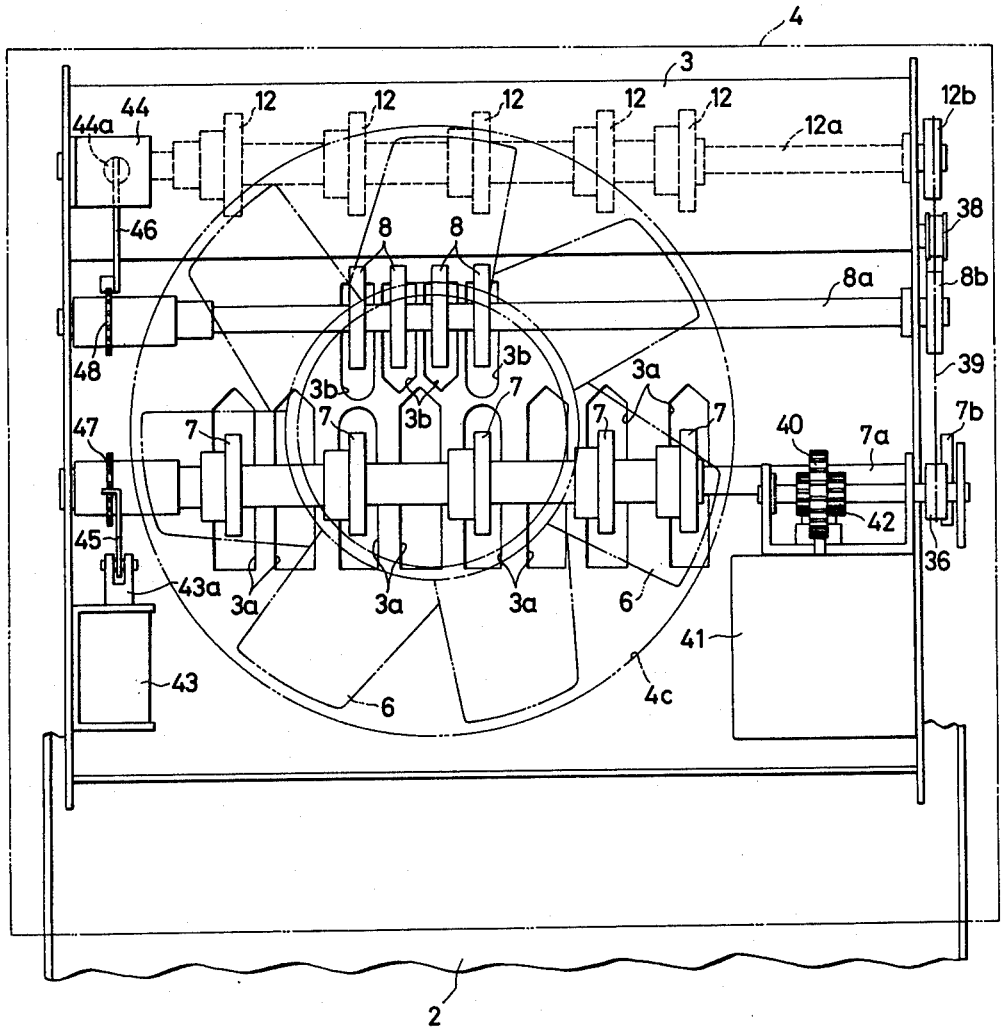
FIG. 5 is a partial broken plan view of the embodiment of FIG. 4.

Referring to FIGS. 4 and 5, there are shown a schematic sectional view and a schematic plan view of another embodiment of the invention, respectively, which is employed in a sheet feeding apparatus of the air suction type of a facsimile apparatus.

In FIGS. 4 and 5, reference symbol X represents a sheet processing section, reference numeral 1 sheets, reference numeral 11 a scanner roller, reference numeral 12 an auxiliary roller, reference numeral 13 a sheet path, reference numeral 6 a fan, reference numeral 4 a casing, reference numeral 8 a sheet separating roller, reference numeral 9 a frictional sheet separating plate, reference numeral 15 a guide roller, reference numeral 16 a pressure roller, reference numeral 17 a scanner, reference numeral 18 a recording stylus, and reference numeral 19 the other scanner roller. Since the respective operations of these members are almost the same as those of the members in FIG. 1, the explanation thereof is omitted here, and their constructions and actions will now be explained.

Referring to FIG. 4, the sheet processing section X is disposed within a facsimile apparatus body 20 and is composed of a pair of guide plates 21, 22, which are disposed so as to face each other along the sheet path between a pair of the scanner rollers 11, 19, the scanner 17 and the recording stylus 18 which are disposed so as to be directed to an image reading section and a recording section of the facsimile apparatus. In the sheet path upstream of the scanner roller 11, there are disposed another pair of guide plates 23, 24, which are similar to the above-mentioned guide plates 21, 22, along the sheet path. Each of the guide plates 23, 24 is held between two side walls (not shown) of the facsimile body 20. Furthermore, each of the scanner rollers 11, 19 and each of the pressure rollers 16, 25 which are disposed in pressure contact with the scanner rollers 11, 19, respectively, are rotatably held between the two side walls (not shown) and are respectively rotated stepwise by a step motor (not shown) which is driven so as to be rotated stepwise by a predetermined angle in accordance with the input of a clock pulse.

In each of the guide plates 21, 22, 23 and 24, there are formed through holes. Through each of these through holes, there are formed sheet detection optical paths of sheet detectors S1 and S2 which are respectively constructed of a light receiving element and a light emitting element. An upstream end portion 24*a* of the guide plate 24 is connected to an end portion, on the side of the facsimile apparatus, of an original guide plate 26 for leading a facsimile transmission original (not shown) to the scanner roller 11.

The sheets 1 are stacked on the sheet receptacle 2. The sheet receptacle 2 is fixed to a lower portion of the casing 4, which is situated above the original guide plate 26, by a pair of lugs 2*a* (a front lug not shown), whose opposite ends are bent in the shape of letter L, being fixed between the two side walls 4*a* of the casing 4. The end portion of the sheet receptacle 2 on the side of facsimile apparatus body 20 is bent upwards in the shape of letter L, so that the bent portion constitutes a paper stopper 2*b*. In the paper stopper 2*b*, there is formed a lug 28 which is substantially integral with the paper stopper 2*b*. The frictional sheet separating plate 9 is swingably supported by the lug 28. A hanging piece 29*a*, which is formed integrally with a support member 29 of the frictional sheet separating plate 9, and the lug 28 are connected to each other by a taut spring 30. To the support member 29 is given a counterclockwise rotation bias about a shaft 31 by the tautness of the spring 30. The rotation of the frictional sheet separating plate 9 by the counterclockwise rotation bias is prevented by the upper surface of the plate 9 being in contact with the peripheral surface of the sheet separating roller 8.

The casing 4 is formed like a casket and its inside is separated into a upper housing 33 and a lower housing 34 by a partition panel 32 which is disposed in the middle portion of the casing 4 and parallel to a ceiling plate 4*b*. A lower opening portion of the lower housing 34 is covered with the vacuum plate 3. The vacuum plate 3 is formed stepwise so as to be capable of placing the sheet feed roller 7 and the sheet separating roller 8 therein. In the portions of the vacuum plate 3 corresponding to the positions of the sheet feed roller 7 and the sheet separating roller 8, there are formed a number of comparatively large sheet suction apertures 3*a*, 3*b* in the form of the teeth of a comb in order that the respective peripheral surfaces of the rollers 7, 8 are projected from a lower portion of the vacuum plate 3. These apertures serve as air suction inlets from a fan as will be described.

The sheet feed roller 7, auxiliary roller 12 and sheet separating roller 8 are respectively composed of coin-like rollers which are disposed with a predetermined space therebetween on their respective shafts 7*a*, 12*a*, 8*a*.

A one-way rotation clutch (not shown) is equipped between each of the shafts 7*a*, 8*b* of the sheet feed roller 7 and the sheet separation roller 8 and each of the rollers 7, 8 mounted on the shafts 7*a*, 8*b*, so that each of the rollers 7, 8 is rotatable counterclockwise with respect to each of the shafts 7*a*, 8*a* in FIG. 4.

Between a shaft 12*a* of the auxiliary roller 12 and each roller mounted on the shaft 12*a*, there is equipped a thrust spring (wave washer) and when an abnormal load, for example, due to paper jam, is applied to the auxiliary roller 12, the thurust spring (not shown) makes the support shaft 12*a* slip with respect to each roller mounted on the shaft 12*a*, so that it is prevented that such an abnormal load is applied to a feed motor which will be described later. Each of the shafts 7*a*, 12*a*, 8*a* and a guide roller 15 are rotatably supported between the two side plates 4*a* of the casing 4 in a manner as to be normal to the sheet feeding direction and almost parallel to the surface of stacked sheets. In FIGS. 4 and 5, pulleys 7*b*, 8*b* are mounted on the respective front end portions of the shafts 7*a*, 8*a* through spring clutches (not shown), and a pulley 12*b* is fixed to an end portion of the shaft 12*a*. Each of these pulleys is connected to a drive pulley 36 which is pivotally supported by a casing side plate of the upper housing 33, by each of idler pulleys 37, 38 which are pivotally supported in the same manner as in the case of the drive pulley 36.

The drive pulley 36 is constructed coaxially and integrally with a worm wheel 40. The worm wheel 40 is driven by a worm 42 fixed to the drive shaft of a feed motor 41. The feed motor 41 is fixed to a partition plate 32 within the upper housing 33. On the partition plate 32 of the upper housing 33, there is fixed a fan 6 of the type having moving vanes in the peripheral portion of the feed motor 41, and by the rotation of the fan 6, air within the lower housing 34 is discharged therefrom through an opening 32*a* of the partition plate 32 between the upper and lower housings 33, 34 through a net-like opening 4*c* disposed in an upper portion of the casing 4, so that a negative pressure state is attained in the lower housing 34. To an inner wall of the upper housing 33, there is fixed a selenoid 43 for a sheet feed roller clutch, and a selenoid 44 for a sheet separating roller clutch. In each of sliding members 43*a*, 44*a* of the solenoids 43, 44, there is engaged one arm end portion of each of two-arm members 45, 46. Each of the other arm portions of the two-arm members 45, 46 is bent in the shape of letter L and the respective bent portions are engaged in the respective pawls of ratchet wheels 47, 48, which are coaxially fixed to the shafts 7*a*, 8*a*. The fan 6 is energized by depressing a start button (not shown) to bring the lower housing 34 to a negative pressure state, so that a top sheet of the sheets 1 stacked on the sheet receptacle 2 is sucked to the lower surface of the vacuum plate 3. The fan 6 is deenergized by a signal generated from the sheet detector S1 when the leading edge of the sheet 1 intercepts the sheet detection optical path of the sheet detector S1. The feed motor 41 beings to be energized at almost the same time as the start of energizing of the fan 6, so that the pulleys 7*b*, 12*b*, 8*b* are respectively rotated by the timing belt 39. With the rotation of each of the pulleys, only the auxiliary roller 12 is rotated. The operation of the feed motor 41 is stopped in a short time after receiving a signal indicating that the rear end portion of the sheet 1 has opened the sheet detection optical path of the sheet detector S2. The respective solenoids 43, 44 are energized in a few seconds after the fan 6 has been energized, and the respective arm end portions of the two-arm members 45, 46 are disengaged from the respective pawls of the ratchet wheels 47, 48, and the respective rotations of the pulleys 7*b*, 8*b* are transmitted to the shafts 7*a*, 8*b* through spring clutches, so that the sheet roller 7 and sheet separating roller 8 are rotated respectively. The solenoid 43 is deenergized by a signal indicating that the leading edge of the sheet 1 intercepts the optical path of the sheet detector S1, while the solenoid 44 is deenergized by a signal indicating that the leading edge of the sheet 1 intercepts the optical path of the sheet detector S2, whereby the rotations of the rollers 7, 8 are stopped successively.

What is claimed is:

1. In a sheet feeding apparatus comprising a sheet receptacle for placing sheets thereon, a vacuum plate which is disposed above said sheet receptacle and which has a sheet suction hole in a bottom portion thereof directed to said sheet receptacle, a casing for covering said vacuum plate, a fan for bringing a space between said vacuum plate and said sheet receptacle to a negative pressure by sucking air from said casing, a sheet feed roller, which is disposed rotatably in said casing and a sheet transport portion which is exposed to the side of said sheet receptacle through said vacuum plate, a sheet separating roller which is rotatably disposed, downstream of said sheet feed roller, in sheet transport path, and a drive apparatus for driving each of said rollers in the sheet feeding direction, the improvement wherein said sheet separating roller is disposed in said casing and part of the peripheral surface of said sheet separating roller is exposed to the side of the said sheet receptacle through said vacuum plate and in contact with a frictional member disposed below said sheet separating roller.

2. A sheet feeding apparatus as in claim 1, wherein said sheet separating roller is rotated stepwise by an intermittent movement means when said sheet separating roller guides sheets individually along the surface thereof.

3. A sheet feeding apparatus as in claim 1, wherein said sheet separating roller brings the leading edge of each sheet separated into contact with said frictional member with an acute angle.

4. A sheet feeding apparatus as in claim 1, wherein said frictional member is urged by spring means so as to be brought into contact with the surface of said sheet separating roller.

5. A sheet feeding apparatus as in claim 2, wherein said intermittent movement means comprises a ratchet connected to a solenoid means.

* * * * *